United States Patent [19]

Koch et al.

[11] Patent Number: 4,552,681

[45] Date of Patent: Nov. 12, 1985

[54] GRANULAR, FREE-FLOWING DETERGENT COMPONENT AND METHOD FOR ITS PRODUCTION

[75] Inventors: Otto Koch, Leichlingen; Herbert Reuter, Hilden; Wolfgang Seiter, Neuss, all of Fed. Rep. of Germany

[73] Assignee: Henkel Kommanditgesellschaft auf Aktien, Duesseldorf, Fed. Rep. of Germany

[21] Appl. No.: 678,385

[22] Filed: Dec. 6, 1984

Related U.S. Application Data

[63] Continuation-in-part of Ser. No. 541,569, Oct. 13, 1983, abandoned.

[30] Foreign Application Priority Data

Dec. 10, 1983 [DE] Fed. Rep. of Germany ..... 3344698

[51] Int. Cl.[4] ..... C11D 3/075; C11D 3/12; C11D 11/02; C11D 17/06

[52] U.S. Cl. ..... 252/140; 159/4.61; 159/4.04; 159/4.2; 159/48.1; 252/135; 252/174; 252/174.21; 252/174.25

[58] Field of Search ..... 159/4 R, 4 B, 4 CC, 159/4 S, 48.1; 252/90, 99, 109, 135, 140, 174, 174.21, 174.25

[56] References Cited

U.S. PATENT DOCUMENTS

| | | | |
|---|---|---|---|
| 2,798,544 | 7/1957 | Davis | 159/48 |
| 3,055,835 | 9/1962 | Monick | 159/4 CC |
| 3,344,836 | 10/1967 | Kopczynski | 159/4 S |
| 3,519,054 | 7/1970 | Cavataio | 159/4 CC |
| 3,629,951 | 12/1971 | Davis et al. | 159/4 CC |
| 3,799,880 | 3/1974 | Kelly | 252/110 |
| 3,849,327 | 11/1974 | Disalvo | 252/109 |
| 3,940,341 | 2/1976 | Gray | 252/105 |
| 3,962,149 | 6/1976 | Chirash | 252/540 |
| 4,064,063 | 12/1977 | Alder | 252/135 |
| 4,129,511 | 12/1978 | Ogoshi | 252/140 |
| 4,140,650 | 2/1979 | Wilde | 252/135 |
| 4,264,464 | 4/1981 | Gangwisch | 252/91 |
| 4,276,326 | 6/1981 | Joshi | 427/220 |

*Primary Examiner*—Dennis L. Albrecht

*Attorney, Agent, or Firm*—Ernest G. Szoke; Nelson Littell, Jr.; Henry E. Millson, Jr.

[57] ABSTRACT

This invention relates to a granular, free-flowing detergent component which dissolves rapidly in water and which has a powder density of from 550 to 900 g/l, consisting of synthetic, essentially nonionic surfactants, inorganic supports, other organic washing aids, and water bound by adsorption and in hydrate form. The detergent component is produced by spray-drying, and more than 50% by weight thereof consists of droplet-like to rodlet-like particles having an average diameter of from about 0.02 to 1.5 mm, an average length of from about 0.1 to 5 mm, and a ratio of average diameter to average length of from about 1:1.2 to 1:10, optionally coated with a finely divided water-soluble or water-dispersible solid material as a fluidity improving agent.

38 Claims, 7 Drawing Figures

GRANULAR, FREE-FLOWING DETERGENT COMPONENT AND METHOD FOR ITS PRODUCTION

Figure 1:
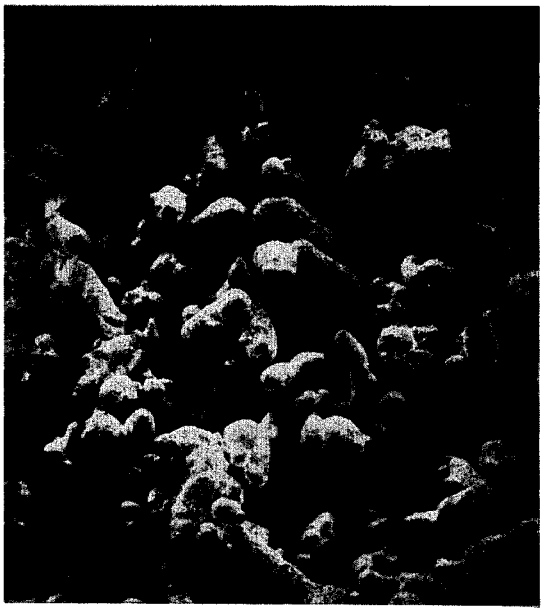
Figure 2:
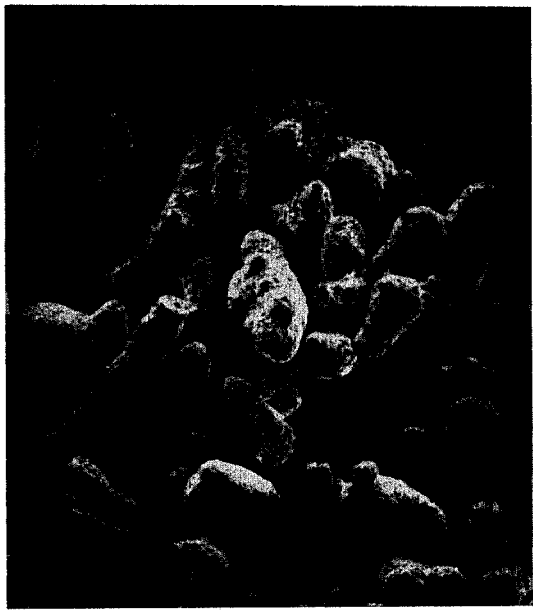
Figure 3:
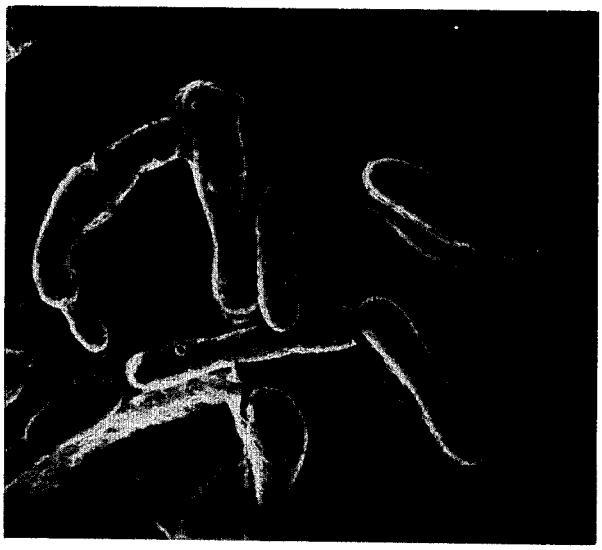
Figure 4:
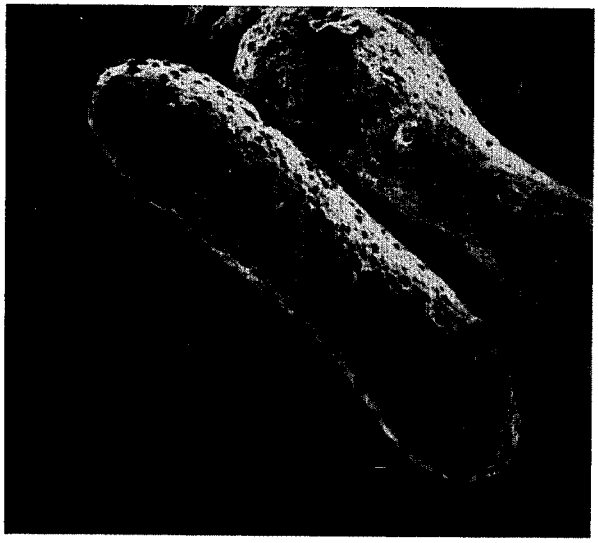

This is a continuation-in-part of Ser. No. 541,569, filed Oct. 13, 1983, abandoned on transfer of the drawings to this application.

This invention is directed to a detergent component. More particularly, this invention is directed to a granular, free-flowing, high powder density detergent component and the preparation thereof.

Detergents having a relatively high powder density of more than 600 gm/l have recently attracted greater interest because they require less packaging volume for the same active substance content and, hence, provide for savings of packaging raw materials. Washing powders having a high bulk density have long been known in principle and include, for example, compositions of high soda or silicate content of the type previously obtained, for example, by simple mixture of the individual constituents or by drying of aqueous mixtures on shelves or heated rollers, extrusion, or spray crystallization. These powders having high specific gravity tend to cake, generally show poor dissolving properties, and cannot be used in modern washing machines with preprogrammed washing cycles. Accordingly, these powders have meanwhile been replaced by low specific gravity, porous powders produced by hot spray-drying which, although dissolving relatively quickly, are fairly voluminous for packaging and transport.

It is also known that the powder density of spray-dried powders of the type in question can be increased by subsequently spraying them with liquid or molten nonionic surfactants. Due to the favorable washing properties of nonionic surfactants, this also increases the detergent effect of the powders and avoids the problem encountered in hot spray drying of smoke formation in the exhaust air of the spray towers which is caused by entrained nonionic material. However, if the process described in German Published Application (DE-AS) No. 10 98 132, in which the nonionic surfactant is applied to spray-dried polyphosphate, is adopted, powder densities of less than 500 gm/l are obtained.

By use of a similar process described in U.S. Pat. Nos. 3,838,072, 3,849,327, and 3,886,098, whereby it is possible by spray-drying of a slurry containing inorganic salts such as sodium silicate, sodium sulfate, and sodium tripolyphosphate, as well as sulfonate surfactants and soap, to produce a granular porous carrier material. This carrier material is subsequently sprayed with a nonionic surfactant in a mixer. In this way, it is possible to post-add up to 20% by weight of the nonionic surfactant onto the spray-dried carrier material. In order to improve the flowability the use of a powder additive such as e.g. talcum, microfine silic acid or calcined clay is proposed. Likewise, a redeposition inhibitor in powder form such as carboxymethyl cellulose, may be post-added. The powders such obtained being loaded with nonionic surfactants may have a powder density of more than 500 g/l, e.g. 700 g/l, and a fluidity of, e.g. up to 76%, based on that of dry sand, the size of the particles being between 3.3 mm and 0.775 mm, especially between 0.83 mm and 0.15 mm.

Granular detergents having a powder density of at least 500 gm/l, which consist of substantially spherical particles of a certain size and which have a fluidity of 70%, based upon dry sand, are known from German Published Application (DE-OS) No. 27 42 683. These detergents, which are packed in plastic bottles, contain from 30 to 80% of builders, from 2 to 40% of substantially nonionic surfactants, from 0 to 20% of other additives, from 0 to 50% of fillers, and from 3 to 15% of moisture. Although the products thus described are said to lend themselves to production in any way, for example, even by spray-drying or granulation, the only specifically illustrated and, therefore, usable method involves a two-stage, expensive production process in which so-called base beads having a porous outer surface and a more or less absorbent internal structure are first produced by spray-drying an aqueous slurry and are then sprayed or impregnated with the liquid or molten nonionic surfactant. Apart from the complicated nature of the production process, difficulties are involved in producing tack-free particles containing more than 20% by weight of liquid or low-melting nonionic surfactants. In addition, the products dissolve relatively poorly in cold tapwater so that undissolved fractions can remain behind in the powder compartments or in the liquid container of tumbler-type washing machines.

Finally, German Published Application (DE-AS) No. 17 92 434 describes a process for the production of granular detergents containing from 2 to 15% by weight of anionic surfactants, from 5 to 20% by weight of nonionic surfactants, and from 25 to 60% by weight of tripolyphosphate by spray-drying a slurry. The tripolyphosphate used for making up the slurry has to be partly prehydrated, the partial prehydration being necessary to ensure that pourable powders are obtained. This known process gives loose powders having a powder density of less than 550 gm/l and, where the nonionic surfactant content is considerably in excess of 15% by weight, only very moderate free-flow properties. Thus, it is impossible to transfer the powder in specific quantities from a pack or bottle into a measuring cup because it does not flow uniformly. Instead, the powder, rather than flowing uniformly out of a package tilted for pouring, piles up, even with careful shaking, or shoots uncontrollably out of the opening, resulting frequently in overfilling of the measuring cup and in the spilling of relatively large quantities of powder.

Accordingly, there has been a need to produce a granular detergent—without any of the well-known disadvantages—which:

(1) has a high powder density so that the packing volume can be considerably reduced, i.e., to approximately one-half of that of a standard spray-dried powder;

(2) has a considerably increased, i.e., approximately doubled, content of wash-active substance so that the user obtains the same detergent powder as from a conventional spray-dried powder, despite minimal dosage, for example, a dosage reduced by half;

(3) despite the resulting high content of nonionic surfactants, which are known to increase the tendency of a powder to cake, flows so freely that it pours out as if a liquid and may be accurately dispensed into a measuring cup simply by tilting the supply pack; and (4) may be produced by a single-stage process without any particular problems arising.

However, in these regards, the artisan has been confronted by the following problems:

A spray-drying process carried out under standard conditions, i.e., by the pressure atomization of aqueous suspensions, did not appear altogether promising for solving this problem because this procedure generally leads to expanded, i.e., porous, granules with correspondingly low powder densities. Although the subsequent incorporation of or impregnation with liquified nonionic surfactants would have enabled the pores in the granules to be more or less filled and the powder density to be increased accordingly, the two-state procedure involved would have been time-consuming and expensive with regard to equipment due to the need to use, mix, and granulate large quantities of powder and to thereafter separate the coarser aggregates.

In addition, there were serious objections to the spray-drying of powders of high surfactant content, particularly high nonionic surfactant content, due to the danger of dust explosions and considerable smoke formation in the exhaust air of the spray-drying towers. It is for this reason that the relevant specialist and patent literature warns against processing high-surfactant mixtures such as these in hot spray-drying towers, proposing instead that relatively large amounts of nonionic surfactant be applied by spray granulation to preformed supporting granules. This method of post-addition usually takes place in continuously or discontinuously working mixing devices whereby the supporting granules are subject to an intensive mechanical treatment.

Therefore, such a treatment makes it necessary to produce relatively solid, i.e. abrasion-resistant, granules. Granules of this type, particularly where they contain large amounts of sodium silicate to improve their strength, show inadequate solubility properties, particularly in cold water, having often only a limited capacity for taking up liquid or sticky nonionic surfactants.

It is an object of this invention to provide a novel detergent component.

It is also an object of this invention to provide a granular, free-flowing, high powder density detergent component and a method of preparing same.

It is a further object of the invention to provide a granular, free-flowing detergent component which dissolves rapidly in water and which has a powder density of from about 550 to 800 gm/l, the detergent component consisting essentially of synthetic, substantially nonionic surfactants, inorganic supports, additional organic washing aids, and water bound by adsorption and in hydrate form, wherein the composition is produced by spray-drying and more than 50% by weight of the total composition comprises droplet-like to rodlet-like particles having an average diameter of from about 0.02 to 1.5 mm, an average length of from about 0.1 to 5 mm, and an average diameter to average length ratio of from about 1:1.2 to 1:10.

These and other objects of the invention will become more apparent in the discussion below.

Figure 5:
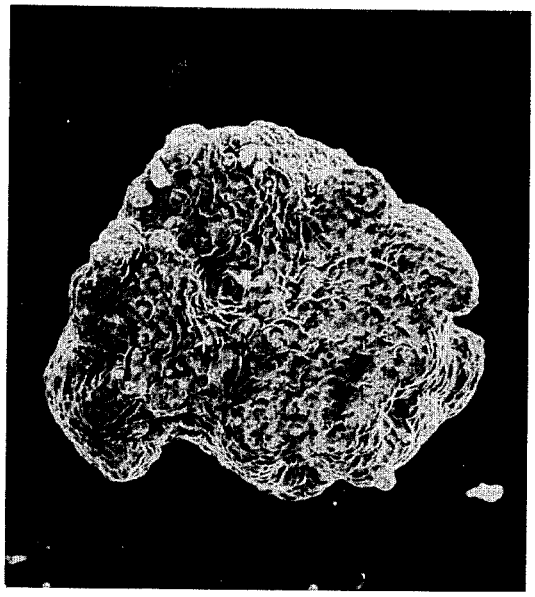
Figure 6:
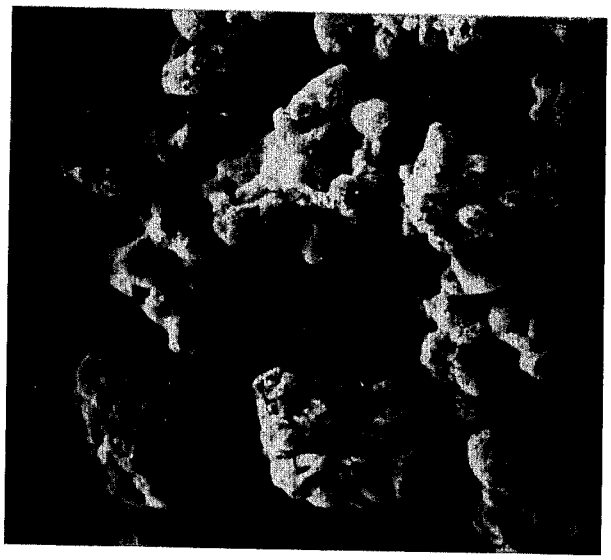
Figure 7:
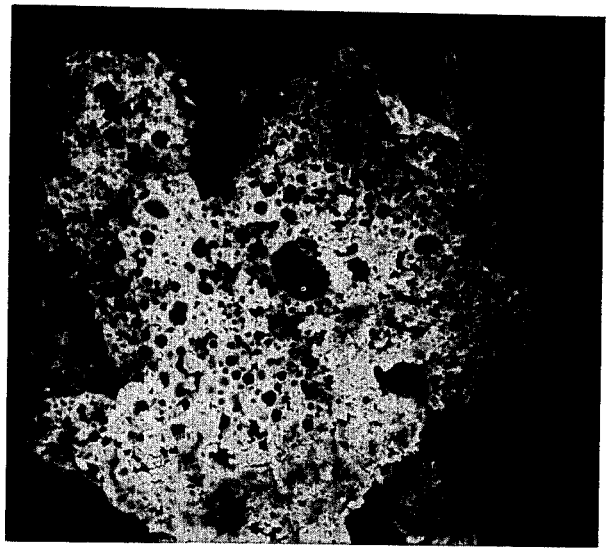

FIGS. 1 to 5 are pictures, in increasing magnification, of a detergent composition according to the invention; and FIGS. 6 and 7 are pictures of a conventional spray-dried detergent powder.

The present invention, by which the problems mentioned above are solved, relates to a granular, free-flowing detergent component which dissolves rapidly in water and which has a powder density of from about 550 to 800 gm/l, consisting essentially of synthetic, substantially nonionic surfactants, inorganic supports, additional organic washing aids, and water bound by adsorption or in hydrate form. This granular detergent composition is characterized in that it is produced by spray-drying and in that more than 50% by weight thereof consists of droplet-like to rodlet-like particles having an average diameter of from about 0.02 1.5 mm, an average length of from about 0.1 to 5 30 mm, and an average diameter to average length ratio of from about 1:1.2 to 1:10. This granular detergent component is the essential ingredient of a free-flowing granular detergent composition being produced by admixing further powder components. However, the free-flowing granular detergent component as defined above may also constitute the practically sole ingredient of the detergent. Accordingly, the granular detergent component of this invention is present in a granular detergent composition in amounts ranging from 15 to 100% by weight, preferably from 50 to 95% by weight.

Suitable alkoxylated nonionic surfactants comprise ethoxylated alcohols containing from 12 to 24, preferably from 14 to 18, carbon atoms and an average of from 3 to 20, preferably from 4 to 16, glycol ether groups. The hydrocarbon radicals may be saturated or monounsaturated, linear, or even methyl-branched in the 2-position (oxo radical) and derived, for example, from naturally occurring or hydrogenated fatty compounds and/or synthetic compounds. Ethoxylates derived from cetyl, stearyl, and oleyl alcohol and mixtures thereof have proven to be particularly suitable. Examples thereof include tallow fatty alcohol containing an average of from 4 to 8 ethylene oxide groups (EO), tallow fatty alcohol containing an average of from 10 to 18 EO, and oleyl alcohol containing an average of from 6 to 12 EO, and also mixtures thereof.

Mixtures of two and more surfactants differing in their EO-content, in which the percentage of more highly ethoxylated alcohols predominates, have proven to be particularly advantageous because the tendency towards smoke formation in the exhaust air (so-called "pluming") is minimal and the detergent effect with respect to mineral and fat-containing soil is particularly pronounced. Examples of mixtures of this type are mixtures of (a) tallow alcohol containing from 4 to 6 EO,
(b) tallow alcohol containing from 12 to 16 EO, and
(c) technical oleyl alcohol (i.e., mixtures of oleyl and stearly alcohol) containing from 6 to 12 EO, for example, in a ratio of (a):(b) of from about 2:1 to 1:4 or in a ratio of (a):(b):(c) of from about 2:1:1 to 2:1:4 or from about 1:1:1 to 1:4:1.

Alkoxylated alcohols of the type in whose production first 1 to 3 mols of propylene oxide and then 4 to 20 mols, preferably 4 to 7 mols, of ethylene oxide are added onto the alcohol, have also proven to be advantageous in the sense of a minimal tendency towards pluming. In particular, they may replace all or part of components (a) and (b) in the above-mentioned mixtures.

Other suitable nonionic surfactants are those which have a similar distribution of the ethylene glycol and propylene glycol ether groups and which are derived from alkyl phenols, fatty amines, fatty acid amides, and fatty acids. The ethoxylated fatty acid amides also include the fatty acid mono- and di-ethanolamides and the corresponding fatty acid propanolamides. It is also possible to use the water-soluble polyethylene oxide adducts with polypropylene glycol, ethylene diamine polypropylene glycol, and alkyl polypropylene glycol (with from 1 to 10 carbon atoms in the alkyl chain) containing from 20 to 250 ethylene glycol ether groups and from 10 to 100 propylene glycol ether groups. The compounds mentioned normally contain from 1 to 5 ethylene glycol units per propylene glycol unit. Also nonionic surfactants of the aminoxide type may be present; likewise, aminoxides having polyglycolether groups in the molecule may be used.

The detergents contain from 15 to 28% by weight and more preferably from 17 to 25% by weight and more preferably from 18 to 23% by weight, of ethoxylated nonionic surfactants, based upon the total weight of the detergent composition.

The content in the detergents of synthetic anionic surfactants, i.e., those of the sulfonate or sulfate type, should amount to less than about 1%, preferably to less than about 0.5% and more preferably to about 0%, and the soap content should amount to less than 0.2%, preferably to about 0%, based upon the total weight of the detergent composition. Advantageously anionic surfactants are not used because it has surprisingly been found that even small quantities of such additives, particularly minor additions of soap, lead during spray-drying to expansion of the granules and hence to a reduction in the high powder density required and in fluidity.

Suitable inorganic supports comprise, primarily, builder salts which are capable of binding or precipitating the salts responsible for hardness in water. Such builder salts include polymeric phosphates, particularly sodium tripolyphosphate, and more highly condensed polymeric phosphates, such as sodium tetraphosphate, for example. The polymeric phosphates may be used in admixture with their hydrolysis products, i.e. ortho- and pyrophosphate, although due to the relatively high detergent and calcium binding power of polyphosphates, suitable measures should be taken to ensure that the polyphosphate undergoes as little hydrolysis as possible during making up of the slurry and during spray-drying.

Other suitable supports are the synthetic sodium aluminosilicates of the zeolite A type containing bound water, i.e. being in the hydrated form. These zeolites are capable of replacing partly or totally the polymer phosphates, i.e. their use makes it possible to produce zero-phosphate detergent components. The zeolites are used in the usual hydrated, finely crystalline form, i.e. they contain hardly any particles larger than 30 microns in size and consist to a large extent (preferably at least 80%) of particles less than 10 microns in size. Their calcium binding power, which is determined in accordance with DE No. 24 12 837 Al, is in the range from 100 to 200 mg of CaO/g. The zeolite NaA is particularly suitable, although the zeolite NaX and mixtures of NaA and NaX may also be used.

An essential constituent of the support are alkali metal silicates, particularly sodium silicates in which the ratio of $Na_2O$ to $SiO_2$ amounts to from about 1:1.5 to 1:3.5, preferably from about 1:2 to 1:2.5. Mixtures of silicates differing in their alkali metal content, for example, a 1:2 mixture or 1:2.5–3 mixture of $Na_2O$ and $SiO_2$, may also be used, although advantageously in the interests of a high powder density and percentage of silicates having a relatively high $Na_2O$ content should best predominate.

Other suitable supports, which may be used in admixture with the compounds mentioned above, are sodium carbonate, sodium sulfate, and magnesium silicate. Compounds having a high adsorption capacity, such as finely particulate silicas, clays, or bentonites, may also be present.

The percentage of inorganic support amounts overall to from about 40 to 80% by weight, preferably from about 45 to 70% by weight, based upon the weight of anhydrous or nonhydrated constituents. The percentage content in the detergent component of sodium tripolyphosphate (including the hydrolysis products) amounts to from about 0 to 60% by weight, preferably from about 15 to 50% by weight and more preferably from about 20 to 40% by weight, and the percentage of alkali metal silicates amounts to from about 5 to 20% by weight, preferably from about 6 to 15% by weight and more preferably from about 6.5 to 12% by weight, based upon the total weight of the detergent component. The sodium aluminosilicate is present in quantities of from about 0 to 40% by weight, preferably from about 3 to 30% by weight and more preferably from about 5 to 20% by weight, based upon the total weight of the detergent component. The same applies to the case where the percentage sodium aluminosilicate content is increased to beyond the indicated maximum of 40% by weight. In these cases the zeolite content may amount to up to 65% by weight.

Although the percentage polyphosphate content of the detergent may be of the same order as that of conventional heavy-duty detergents, the tendency towards phosphate reduction is fully acknowledged in the invention. First, the detergents according to the invention are used in quantities very much smaller than for conventional, i.e., low specific gravity, washing powders, and, second, the phosphate content may be considerably reduced, i.e., to 10% by weight, in favor of the percentage aluminosilicate content.

The detergent component of this invention may also contain—as additional organic washing aids—so-called co-builders—which, even in small quantities, are capable of considerably enhancing the effect of the polyphosphates and sodium aluminosilicates. Suitable co-builders are, in particular, polyphosphonic acids and their alkali metal salts. Suitable polyphosphonic acids include 1-hydroxyethane-1,1-diphosphonic acid, aminotri-(methylene phosphonic acid), ethylene diamine tetra-(methylene phosphonic acid) and their higher homologs, such as, for example, diethylene triamine tetra-(methylene phosphonic acid). Other suitable co-builders comprise complexing aminopolycarboxylic acids, including in particular alkali metal salts of nitrilotriacetic acid and ethylenediaminetetraacetic acid. The salts of diethylene triamine pentaacetic acid and the higher homologs of the aminopolycarboxylic acids mentioned are also suitable co-builders. The polyacids mentioned are preferably used in the form of their sodium salts.

Other suitable co-builders include polymeric carboxylic acids and their salts having a molecular weight of at least 350 in the form of the water-soluble sodium or potassium salts, such as polyacrylic acid, polymethacrylic acid, poly-α-hydroxyacrylic acid, polymaleic acid, polyitaconic acid, polymesaconic acid, polybutene tricarboxylic acid, and also copolymers of the corresponding monomeric carboxylic acids with one another or with ethylenically unsaturated compounds, such as ethylene, propylene, isobutylene, vinyl methyl ether, or furan. The copolymer of maleic acid and acrylic acid in a ratio of from about 5:1 to 1:5 is mentioned as an example. Small quanitites of these co-builders are to be understood to mean amounts of from 0.5 to 10% by weight, preferably of from 1 to 5% by weight, calculated on the total amount of the detergent component.

Additional organic detergent ingredients which may be present in the spray-dried powder component include redeposition inhibitors, optical brighteners, and additives which improve the viscosity behavior of the slurry, for example, alkali metal salts of toluene, cumene, or xylene sulfonic acid, as well as, optimally, thickening agents such as polymers, e.g. of the Carbopol® type. Suitable redeposition inhibitors are, in particular, carboxymethyl cellulose, methyl cellulose, water-soluble polyesters and polyamides of polybasic carboxylic acids and glycols or diamines containing free carboxyl groups, betaine groups or sulfobetaine groups capable of salt formation, and also colloidally water-soluble polymers and copolymers of vinyl alcohol, vinyl pyrrolidone, acrylamide, and acrylonitrile. These organic detergent auxiliaries may be present in quantities of from about 0.5 to 10% by weight, based upon the total weight of the detergent component.

Suitable optical brighteners are the alkali metal salts of 4,4-bis-(2″-anilino-4″-morpholino-1,3,5-triazinyl-6″-amino)-stilbene-2,2-disulfonic acid or compounds of similar structure which, instead of the morpholino group, contain a diethanolamino group, a methylamino group, or a β-methoxyethylamino group. Other suitable optical brighteners include brighteners of the substituted diphenyl styryl type, for example, the alkali metal salts of 4,4-bis-(2-sulfostyryl)diphenyl, 4,4-bis-(4-chloro-3-sulfostyryl)-diphenyl, and 4-(4-chlorostyryl)-4-(2-sulfostyryl)-diphenyl.

The detergent component of the invention normally has a water content of from about 8 to 20% by weight, preferably from about 10 to 16% by weight, which is to be understood to mean both the water bound by adsorption and water of hydration.

The amount of water being bound in the hydrated sodium aluminosilicate is in the region of about 20% by weight related to the total amount of hydrated sodium aluminosilicate, i.e. it is the degree of hydration of the sodium aluminosilicate being in equilibrium with its surroundings. This fraction must be taken into account in calculating the quantity of water. Basically, the quantity of water present should be measured in such a way that satisfactorily free-flowing products are obtained. The preferred water content amounts to from about 10 to 16% by weight, based upon the total weight of the detergent component.

The grain structure of the powder component according to the invention is characteristic and, in this respect, differs considerably from that of known and commercially available detergents. The powder component of the invention consists predominately, i.e., to an extent of from 65 to 100% by weight, based upon the total weight of the detergent component, of droplet to rodlet-like particles which, for an average diameter of from about 0.02 to 1.5 mm, preferably from about 0.05 to 1 mm, and an average length of from about 0.1 to 5 mm, preferably from about 0.3 to 3 mm, have a diameter-to-length ratio of from about 1:1.2 to 1:10, preferably from about 1:1.4 to 1:8, with a pronounced maximum at about 1:1.8 to 1:5. The particles are compact, i.e., they have a dense, non-sponge-like or non-foam-like structure. Their surface is uninterrupted, i.e., non-porous and appears smooth when viewed macroscopically, i.e. with the naked eye. Examination of their surface under a microscope reveals a texture which may be described as grained to striated and is reminiscent of solidified, non-porous slag.

FIGS. 1 to 5 show, with increasing magnification, characteristic particles of the detergent component according to the invention. The end of one such particle at a fracture is shown in FIG. 5. This example shows that the structure can continue inside the particles.

FIGS. 6 and 7 which, for comparison, illustrate a conventional spray-dried powder of low powder density, show agglomerated particles of irregular, approximately spherical form and with a substantially smooth surface. As can be seen from the cross-section of a particle shown in FIG. 7, the interior of the individual particles is expanded and shows a porous sponge-like or foam-like structure characteristic of such spray-dried powders. Powder structures such as these are not the subject of the present invention.

The language "to an extent of more than 50% by weight" or "preferably [to an extent of] more than 65 to 100% by weight" of droplet-like or rodlet-like particles means that the detergents may also be made up to a smaller extent of particles having a different shape, i.e., two or more droplet-like to rodlet-like particles are cemented to form irregular agglomerates, or small numbers of approximately spherical particles are formed during production or elongate particles break up into short fragments during further processing or during transport. Additional powder constituents which have not been spray-dried and which have a different powder spectrum, for example, bleaches, bleach activators, enzymes, and foam inhibitors, may also be added to the detergent component according to the invention.

Detergent premixes, so-called compounds, being made up of sulfonate and/or sulfate surfactants and, optionally, also of soaps, together with carriers such as sodium tripolyphosphate, zeolite A, and waterglass, and being prepared by usual spray-drying or granulating methods, also belong to this type of additional powder products. Likewise, textile softening granulates containing quaternary ammonium compounds as active ingredients together with soluble or insoluble carriers and dispersion inhibitors, or other textile softening granulates formed with laminated silicates and long-chained tertiary amines, may be used as additives.

These additional powder constituents may be made up of differently shaped particles, for example, of more or less spherical prills or granulates. They should be of such a structure and used in such a quantity that they do not reduce the power density and free-flow properties of the detergents to any significant extent, if at all. This powder density amounts to from about 550 to 800 gm/l, preferably from about 600 to 750 gm/l and more preferably from about 620 to 720 gm/l.

Although the detergent components of the invention are only suitable to a limited extent for the determination of particle size distribution by sieve analysis on account of their characteristic rodlet-like powder structure, it is possible to determine the grain spectrum by that method. Results show that the grain spectrum is relatively narrow, i.e., more than about 70% by weight and, in most cases, even from about 80 to 90% by weight of the powder lies within a meshwidth range of from about 0.2 to 0.8 mm. With a conventional spray-dried powder of low powder density, generally no more than from 50 to 70% by weight falls within this grain size range. The dust content of the detergent component and also the percentage of oversize grain are also correspondingly low so that the spray-dried powder does not have to be subsequently sieved nor do any dust binding agents have to be subsequently added.

The detergent components according to the invention are free-flowing and are superior in their fluidity to the known spray-dried hollow-bead powders of low specific gravity. Their fluidity is comparable with that of dry sand and, according to the results of a test described in the examples below, amounts to from about 75 to 95% of that of a dry sand having a certain grain specification. This high fluidity, which is far superior to the fluidity of substantially spherical spray-dried powders of comparable grain size, is extremely surprising because, with increasing deviation from spherical dimensions, the powder particles would normally have been expected to lose their free-rolling property.

It is also surprising that despite the high content of nonionic, tacky surfactants and the absence of microcavities capable of taking up these surfactants, the particles do not show any tendency to agglomerate or to give off these tacky constituents. In contrast to powders having an equally high content of nonionic surfactant, in whose case the nonionic surfactant is applied to absorbent spray-dried granulates produced beforehand, even the nonionic surfactant cannot be removed again by squeezing between filter papers. Accordingly, the detergents according to the invention also do not cause standard, uncoated cardboard packs to become greasy or to "leak."

Another aspect of the invention is the ability of the powder to contract. It is unavoidable in the automatic packaging of a detergent that the detergent should initially occupy a slightly greater volume which decreases only slightly, even in the event of brief shaking. During the transportation of the packages to the consumer, a gradual contraction or settling takes place. The consumer notices this reduction in volume upon opening the package and frequently comes to the conclusion that he or she has been sold an incompletely filled package. With conventional hollow-bead powders of low specific gravity, this reduction in volume amounts to from about 10 to 15%. Predominantly spherical granulates obtained, for example, by applying nonionic surfactant to presprayed support grains show reductions in volume on the order of about 10%. In the case of dry sand, this value is about 8%. The detergent compositions according to the invention exceed even these values, i.e., in their case the reductions in volume are usually below 10% and, in favorable cases, reach 5%. Their high volume stability coupled with their outstanding fluidity makes the detergents according to the invention easier to dispense in exact reproducible quantities both at the packaging stage and in practical application.

In some cases it is of advantage to have the granulates of the invention covered with a finely divided solid as a fluidity improving agent. This solid material may be soluble or insoluble in water, and may be present in amounts of from 0.01 to 3% by weight of the granular spray-dried product.

This cover further improves the fluidity of the product and also imparts weather-resisting properties to the product. The finely divided synthetic zeolites of the type NaA, and NaX respectively, have been found to be of special value as such coating agent. The positive effect of these zeolites is not confined to the improvement of fluidity but also increases the builder amount and, therefore, the washing power of the product. Further, microfine silica, especially pyrogeneous silica, may be used as fluidity improving agent. The amount of the fluidity improving agent is preferably 0.1 to 2% by weight in the case of the zeolites, and, in the case of the microfine silica, preferably 0.05 to 0.5% by weight, with respect to the granular spray-dried product.

Likewise, other powder materials such as finely divided sodium tripolyphosphate, sodium sulfate, magnesium silicate, talcum, bentonite, and organic polymers like carboxymethyl cellulose and urea resins, may also be used, provided the particle size of these powders is below 0.1 mm, e.g. in the range of from 0.001 to 0.08 mm. Coarser powder qualities such as used in detergent and cleaning compositions have to be pulverized previously. Coating agents of this latter type are preferably used in amounts of from 1 to 3% by weight.

The present invention also relates to a process for producing the detergent component according to the invention, wherein a suspension of the constituents containing in all from about 35 to 55% by weight of water (including the water bound by adsorption and the water of hydration) is sprayed by means of nozzles into a drying tower under a pressure measured at the nozzle entrance of from about 16 to 30 bars and for a nozzle orifice diameter of from about 3 to 5.5 mm, the ratio of the pressure at the nozle entrance to the diameter of the nozzle orifice amounting to from about 3 to 9 bars/mm.

Preferably, the pressure at the nozzle entrance is in the range from about 18 to 28 bars, more preferably in the range from about 19 to 25 bars, the diameter of the nozzle orifice amounts to from about 3.5 to 5 mm, and the ratio of the pressure to the diameter of the nozzle orifice is from about 4 to 6 bars/mm, more preferably from about 4.5 to 5.5 bars/mm. The maintenance of these parameters is crucial to the grain properties of the detergent component of the invention. Any distinct overstepping of these limits in either direction, particularly in the event of an increase in pressure or reduction in orifice diameter, results in the formation of more or less irregular to spherical agglomerates with a foam-like structure which in turn leads to a lower powder density and poorer flow properties. An excessive reduction in pressure can lead to defective atomization and to the formation of crusts around the nozzle orifice. Inadequate powder properties are also obtained where the nozzles used have excessively large orifices, i.e. orifices with diameters far larger than 5 mm. It has proven to be particularly favorable, for example, to apply a pressure of from about 19 to 25 bars for a nozzle orifice diameter of from about 3.5 to 4.5 mm. It is advantageous to use nozzles which exert a spin effect on the material to be sprayed.

The spray-drying installation is operated with hot air or hot combustion gases which are preferably guided in countercurrent to the material to be spray-dried. The drying gas is best introduced tangentially into the tower, which produces a certain spin effect. The entry temperature of the drying gas should not exceed 250° C. and is preferably in the range from about 180° to 240° C., more preferably in the range from about 190° to 220° C.

If hotter drying gases are used, it is necessary for the surfactants to be predominantly highly ethoxylated or mixed-alkoxylated surfacatnts to suppress pluming in the exhaust air. If the surfactant mixtures of low and highly ethoxylated compounds described in the foregoing as preferred are used, no pluming occurs providing the entry temperature of the drying gas is kept in the range from about 190° to 220° C., in addition to which the measured emission values are far below the legal maximum.

The temperature of the drying gases upon leaving the drying tower is generally of the order of 90° C.±15° C. and is preferably in the range from about 80° to 95° C. The upper value may be subject to certain fluctuations, dependent upon, inter alia, the outside temperatures, and should be selected in such a way that the temperature in the following dust separators does not fall below the dew point.

The aqueous detergent preparation to be sprayed contains a total of from about 42 to 55% by weight, preferably from 44 to 52% by weight and more particularly from about 46 to 50% by weight of water, including the water bound by adsorption and the water of hydration. Higher water contents are inappropriate because they increase the degree of hydrolysis of the tripolyphosphate, raise energy consumption, and lead to a reduction in power density. Lower contents can lead to a drastic increase in the viscosity of the slurry and thus necessitate special measures, such as increasing mixing and transporting capacity or adding viscosity-reducing agents, such as toluene, xylene, or cumene sulfonate.

Although the order adopted in preparing the slurry is not critical, processing can be made easier by maintaining certain process conditions. In addition, it is advisable to keep the mixing and residence times as short as possible due to the considerable increase in viscosity in the slurry. It is advisable initially to introduce the liquid products, i.e., the molten nonionic surfactants and the constituents already present in aqueous solution or suspension, for example, the aluminosilicate in the form of a filter-moist paste, and—optionally—additional water and then to add the anhydrous constituents, particularly the anhydrous or optionally partly hydrated tripolyphosphate, with vigorous stirring. If anhydrous, slowly hydrating sodium tripolyphosphate of the II-type is used, a drastic increase in viscosity and extensive hydrolysis to lower phosphates are avoided, although this might involve a slight reduction in the fluidity of the spray-dried product. Tripolyphosphate which hydrates more quickly, for example, a tripolyphosphate containing fairly high proportions of the I-type or partly prehydrated tripolyphosphate, leads to higher slurry viscosities. It is an advantage of the process that there is no need to use prehydrated polyphosphate.

In preparing the slurry it is a particularly preferred feature to use anhydrous sodium tripolyphosphate having a content of 30 to 50%, especially 35 to 45% of the modification of the I-type. It is known that tripolyphosphate of the I-type is characterized by an accelerated speed of hydration. This accelerated speed of hydration, however, may cause problems with the handling of the slurry. By the process of hydration free water is withdrawn from the slurry resulting in a strong viscosity increase. A too high slurry viscosity, however, not only complicates the handling, i.e. the mixing, transporting, and spraying of the slurry, but also leads to lower bulk densities of the resulting powder.

In order to assure a sufficient fluidity of the slurry and to obtain spray-dried products with favorable powder properties, it turned out to be suitable to adjust the slurry viscosity to values in the range of from 2000 to maximally 15000 mPa.s, preferably from 5000 to 12000 mPa.s, and particularly from 6000 to 10000 mPa.s. In adjusting the viscosity, heating of the slurry to temperatures of above 85° C., e.g. to 86° C. to 102° C., before adding the solids, especially before adding the tripolyphosphate, is preferred. The heating is suitably done by introducing steam, particularly superheated steam. At the given temperatures, the hydration of the tripolyphosphate in the slurry is to a large extent stopped, or at least so delayed that no unwanted viscosity increase occurs during the handling period. Moreover, the use of strong shearing forces such as intensive mixing with a stirrer or keeping the slurry in circulation with pumping devices, helps to maintain the fluidity of the slurry. The use of strong shearing forces prevents the formation of structured viscosities. In the case of such slurries that do not contain any sodium tripolyphosphate, the preferred viscosity ranges are adjusted through the use of viscosity regulating agents.

The product leaving the spray-tower usually has a temperature of 65° to 80° C. It has been found that under unfavorable conditions, which may occur during a continuous long-term production, deviations with respect to certain product properties such as density and fluidity of the grains happen. Seasonal changes in climate, e.g., may be of influence. In this respect, it has been found that during the processing of the spray-dried powder, particularly in the cooling phase after leaving the spray-tower, high air temperatures are unfavorable. When the spray-dried product still warm after leaving the spray-tower is stored in silos over a longer period, a migration of the nonionic surfactants to the surface of the grains may occur resulting in a decrease of the fluidity but without leading to caking.

This disadvantage can be overcome by subsequent powdering (coating) of the grains as described above. However, it is advantageous to cool the product after it has left the spray-tower without delay, i.e. within less than 5 minutes, preferably within 2 minutes, to temperatures below 35° C., e.g. to 20° C. to 30° C. This, for example, can be done with a pneumatic conveying equipment operating with sufficiently cold air, i.e. having a temperature of less than 30° C. If, during the hot season, the temperature of the cooling air is not sufficient to cool the product fast enough, subsequent powdering is advisable.

The coating, respectively powdering of the spray-dried grains may take place before or after or, preferably, during admixing of other powder compounds. These additional powder components encompass peroxy compounds, bleach activators (so-called peracid precursors), enzyme granulates, foam inhibitors and foam boosters, as well as so-called surfactant or softener compounds, i.e. powder products consisting of carrier substances and surfactants, particularly anionic surfactants, or of carrier substances and textile softeners, respectively. By the simultaneous admixing of the fluidity improving agent and the additional powder components a further mixing step can be avoided. Water insoluble coating agents such as zeolites and silicic acid aerogels may be applied before the termination of the spray-drying, i.e., by injecting these agents in the lower part of the spray tower onto the already formed component grains. The injecting of the coating agent may be done by dosing it into the drying air.

The powdering of the spray-dried grains also leads to a partial smoothing of the grain surface thus further improving the fluidity of such grains. Moreover, by this measure, the bulk density of the powder can be somewhat increased, obviously the coating resulting in a denser packing of the grains.

Therefore, the invention encompasses also a process for the after-treatment of the granular, spray-dried powder component in a mixing device by admixing 0.01 to 3% by weight of the finely divided solid of the above definition.

As for the rest, it is possible to use any of the apparatus and process aids which are known to those skilled in the art of modern spray-drying technology.

Other constituents in powder or granular form may be added to and mixed with the spray-dried detergents. Such constituents include substances which are unstable or which would completely or partly lose their specific effect under spray-drying conditions. Additives of this type, which are added to the powder after spray-drying, include enzymes from the class of proteases, lipases, and amylases or mixtures thereof. Enzymes obtained from bacterial strains or fungi, such as *Bacillus subtilis, Bacillus licheniformis* and *Streptomyces griseus,* are particularly suitable. In general, fragrances and anti-foaming agents, such as silicones or paraffin hydrocarbons, are also subsequently added to the spray-dried powder component to avoid losses of activity.

The bleaching component may be any of the perhydrates and per compounds normally used in detergents and bleaches. Preferred perhydrates are sodium perborate, which may be used in tetrahydrate or even monohydrate form, the perhydrates of sodium carbonate (sodium percarbonate), sodium pyrophosphate (perpyrophosphate), sodium silicate (persilicate), and urea. These perhydrates may be used together with bleach activators.

The preferred bleach component is sodium perborate tetrahydrate used in conjunction with bleach activators. The bleach activators include, in particular, N-acyl compounds. Examples of suitable N-acyl compounds comprise polyacylated alkylene diamines, such as tetraacetyl methylene diamine, tetraacetyl ethylene diamine, and also acylated glycolurils, such as tetraacetyl glycoluril. Other examples include N-alkyl-N-sulfonyl carbonamides, N-acyl hydantoins, and N-acylated cyclic triazoles, urazoles, diketopiperazines, sulfuryl amides, cyanurates, and imidazolines. In addition to carboxylic acid anhydrides, suitable O-acyl compounds are, in particular, acylated sugars, such as glucose pentaacetate. Preferred bleach activators are tetraacetyl ethylene diamine and glucose pentaacetate.

To avoid interactions with the other constituents of the detergent during storage of the powder-form mixtures, the enzymes, silicone anti-foaming agents, and bleach activators may be granulated and/or coated in known manner with substances that are soluble in water or dispersible in washing liquors. Suitable granulating agents are any of the usual salts which are capable of taking up water of hydration. Suitable coating substances are water-soluble polymers, such as polyethylene glycol, cellulose ethers, cellulose esters, water-soluble starch ethers, and starch esters, and also nonionic surfactants of the alkoxylated alcohol, alkyl phenol, fatty acid, and fatty acid amide type.

The detergent component produced according to the invention is only slightly foam-active, it can be used, therefore, in automatic washing machines without any problems. In cases where stronger foaming is desired in the use of the detergent, particularly in the laundering of delicate textiles, or in laundering at low temperatures which is mostly done by hand, foam-active surfactants and mixtures thereof, preferably in compound form, are post-added. This includes known anionic surfactants of the sulfonate and/or sulfate type and zwitterionic surfactants. Such an admixture may lead to further increase of detergency. This admixture may amount up to 10% by weight, preferably 0.2 to 8% by weight, with respect to the resulting mixture. Anionic surfactants which can be used are for example the alkyl benzenesulfonates, e.g. n-dodecylbenzenesulfonate, olefinsulfonates, alkanesulfonates, primary or secondary alkylsulfates, $\alpha$-sulfofatty acid esters as well as the sulfates of ethoxylated or propoxylated higher molecular weight alkanols, monoalkylated or dialkylated sulfosuccinates, sulfuric acid esters of fatty acid partial glycerides, and fatty acid esters of 1,2-dihydroxypropane sulfonic acid. Useful zwitterionic surfactants are the alkylbetaines, and particularly the alkylsulfobetaines, e.g. the compounds 3-(N,N-dimethyl-N-alkylammonium)-propane-1-sulfonate, and 3-(N,N-dimethyl-N-alkylammonium)-2-hydroxypropane-1-sulfonate. Out of these surfactants, the alkylbenzene sulfonates, olefinsulfonates, alkanesulfonates, sulfates of fatty alkanols, and alpha-sulfofattyacid esters are preferred because of their foam-boosting and simultaneous detergency increasing effects. If foamboosting is the main goal it is advisable to use the sulfates of ethoxylated fatty alkanols having in particular 1 to 3 glycolether units, and the alkylsulfobetaines.

The anionic surfactants and their mixture are preferably used in form of the sodium or potassium salts, or as salts of organic bases such as mono-, di- or triethanolamines. If the above anionic and zwitterionic surfactants have an aliphatic hydrocarbon radical this is preferably straight-chained having 8 to 20, particularly 12 to 18 carbon atoms. In compounds with an aliphatic hydrocarbon radical the alkyl chains have preferably an average of 6 to 16, in particular 8 to 14 carbon atoms.

These optionally used anionic and zwitterionic surfactants are preferably used in granulated form. Granulating agents respectively carrier substances are usual inorganic salts such as sodium sulfate, sodium carbonate, phosphates and zeolites and mixtures thereof.

Textile softening additives are usually consisting of granulates containing a quaternary ammonium compound (QAC), e.g. distearyl dimethyl ammonium chloride, a carrier and an additive delaying the dispersion in the wash liquor. A typical granulate consists, e.g., of 86% by weight of QAC, 10% by weight of pyrogenic silicic acid, and 4% by weight of silicon oil (polydimethylsiloxane activated with pyrogenic silicic acid). Another granulate has, e.g., the composition of 30% by weight of QAC, 20% by weight of sodium tripolyphosphate, 20% by weight of zeolite NaA, 15% by weight of waterglass, and 2% by weight of silicon oil, the remainder being water.

With regard to granulation and/or coating of the additives, every effort should be made to ensure that the powder density and the average grain size of the particles do not deviate significantly from the corresponding parameters of the spray-dried products according to the invention and to ensure that the particles do not have too rough or too irregular a surface. However, since the additional powder constituents are generally not present in a proportion of more than about 10 to 40% by weight, preferably up to 30% by weight based upon the total weight of the final mixture, the effect of the additives on the properties of the powder is generally slight.

The following exemplary material is intended to illustrate the invention and should not be construed as limiting the invention thereto.

EXAMPLES

Example I

A spray-dried product having the following composition:

| Component | % by Weight |
|---|---|
| Tallow alcohol + 14 EO | 7.0 |
| Tallow alcohol + 5 EO | 6.0 |
| Oleyl/cetyl alcohol (1:1 mixture) + 8 EO | 9.5 |
| Sodium tripolyphosphate | 38.0 |
| Zeolite NaA | 12.5 |
| Sodium silicate ($Na_2O:SiO_2$ = 1:2) | 9.0 |
| Na—carboxymethyl cellulose | 0.5 |
| Na—nitrilotriacetate | 0.5 |
| Optical brightener | 0.2 |
| Sodium hydroxide | 0.5 |
| Sodium sulfate | 0.5 |
| Water (13.8% of which is volatile at 130° C.) | 15.8 |
| Total: | 100.0 |

was prepared as follows:

The sodium hydroxide in the form of a 50% solution, the molten ethoxylates, and the sodium silicate in the form of a 36% aqueous solution were initially introduced, followed by the aluminosilicate in the form of a filter-moist paste (54% of water) and the remaining constituents, predominantly in aqueous solution, last of all the anhydrous phosphate. After homogenization, the suspension, which had a total water content of 48.2% and a temperature of 90° C., was sprayed into a spray-drying tower through spin nozzles (orifice diameter of 4 mm) under a pressure measured at the nozzle entrance of 20 bars.

The drying gas, introduced with spin and in counter-current, had an entry temperature of 220° C. and an exit temperature (measured at the filter entrance) of 90° C. The dust explosion limit was not reached at a powder concentration of from 30 to 200 gm/m$^3$, i.e., the product had a dust explosion rating of 0. The smoke meter at the exit of the exhaust filter showed a deflection of between 0.02 and 0.08 scale units (permitted limit: 0.15 scale units), i.e., pluming did not reach a critical level.

After leaving the spray-drying tower the spray-dried product had a temperature of 70° C., and it was cooled in less than 1 minute to a temperature of 28° C. using a pneumatic conveyor.

More than 75% by weight of the spray-dried product consisted of elongate, i.e., rodlet-like to droplet-like, particles having an average length of from about 0.8 to 3 mm and an average diameter of from about 0.1 to 0.6 mm, for an average ratio of diameter to length of from about 1:1.5 to 1:6. The remainder of the product consisted of irregularly agglomerated rodlet-like particles and a small amount of dust. The content of coarse particles (1.6–3 mm) amounted to less than 1% by weight. The powder density of the powder measured 650 gm/l.

To determine fluidity, 1 liter of the powder was introduced into a funnel closed at its outlet end and having the following dimensions:

(a) a diameter of upper opening: 150 mm
(b) diameter of lower opening: 10 mm
(c) height of the conical funnel section: 230 mm
(d) height of the lower cylindrical section: 20 mm
(e) angle of inclination of the conical section (to the horizontal): 70°

For comparison, dry sea sand having the following grain spectrum was used:

| Particle Size (mm) | % by Weight |
|---|---|
| ≦0.1 | 3.1 |
| >0.1, ≦0.2 | 30.1 |
| >0.2, ≦0.4 | 54.7 |
| >0.4, ≦0.8 | 11.9 |
| >1.5 | 0.2 |
| | 100.0 |

The flow-out time of the dry sand after release of the outlet opening was put at 100%. The following comparison values were obtained (average values from 5 tests):

| Test Material | Fluidity (%) |
|---|---|
| (a) Sand | 100 |
| (b) Spray-dried product according to invention | 87 |
| (c) Hollow-bead powder (commercial-grade) | 60–70 |
| (d) Support grain produced by spray-drying and aftertreated with 20% of nonionic surfactant | 86 |

To make a final product, 87.0 parts by weight of the spray-dried product (b) were mixed with 10 parts by weight of powder-form sodium perborate tetrahydrate, which had been sprayed with 0.2 part by weight of perfume oil, 0.5 part by weight of an enzyme granulate produced by prilling an enzyme melt, and 2.5 parts by weight of granulated tetraacetyl ethylene diamine, the grain size of the added constituents being from about 0.1 to 1 mm. The powder density was thus increased to 700 gm/l. There was no change in fluidity within the limits of error.

The mixture proved to be a high-quality detergent usable at temperatures in the range from about 30° to 100° C. With regard to flushability and residue formation in the powder compartments of fully automatic washing machines, there were no visible differences between a loose spray-dried powder and the final product according to the invention. By contrast, the solubility properties of the comparison product (d) were poorer, resulting in the formation of residues in the powder compartments and on the textiles.

Comparison Examples

The spray-drying procedure of Example 1 was repeated several times, with differing modifications. The modifications were as follows:

| Comparison Example No. | Modification |
|---|---|
| I | The orifice diameter of the spray nozzle was reduced to 2 mm for the same pressure (20 bars). |
| II | The pressure was increased to 40 bars for a nozzle orifice diameter of 3 mm. |
| III | The pressure was increased to 40 bars for a nozzle orifice diameter of 4 mm. |
| IV | The pressure was reduced to 15 bars for a nozzle orifice diameter of 5 mm. |
| V | The temperature of the drying gas was increased to 250° C. at |

-continued

| Comparison Example No. | Modification |
|---|---|
| | the entry end and to 94° C. at the tower exit for a nozzle orifice diameter of 4 mm and a pressure of 20 bars. |

As expanded, low specific gravity (<500 gm/l) spray-dried product of high dust content and poor fluidity was obtained in Comparative Example I. Expanded powders of low specific gravity were also obtained in Comparative Examples II and III, the percentage coarse particle content showing a greater increase with Comparative Example III. It was not possible to obtain adequate drying in Comparative Example IV; instead, a moist, lumpy, and unusable product was formed.

In Comparative Example V, the smoke meter showed a reading of 2 scale units, which indicated that smoke emission was over the permitted limit.

Example 2

A spray-dried product having the following composition:

| Component | % by Weight |
|---|---|
| Tallow alcohol + 14 EO | 9.5 |
| Tallow alcohol + 5 EO | 5.0 |
| Oleyl/cetyl alcohol (1:1 mixture) + 8 EO | 7.5 |
| Sodium tripolyphosphate (35% I-type) | 35.0 |
| Zeolite NaA | 14.5 |
| Sodium silicate ($Na_2O:SiO_2$ = 1:2) | 8.8 |
| Na—carboxymethyl cellulose | 0.5 |
| Na—ethylenediaminotetramethylene phosphate | 0.5 |
| Optical brightener | 0.2 |
| Sodium hydroxide | 0.5 |
| Sodium sulfate | 1.7 |
| Water (of which 14.1% is volatile at 130° C.) | 16.3 |
| Total: | 100.0 |

was prepared as follows:

The ingredients were mixed, as described in Example 1, resulting in a slurry with a water content of 46.5% and a viscosity of 9,000 mPa.s. The slurry had been heated to a temperature of 88.5° C. by introducing steam, before the addition of the tripolyphosphate and the zeolite took place. The suspension was sprayed into a spray-drying tower through spin nozzles (orifice diameter 4.1 mm) under a pressure of 22 bars. The drying gas introduced in counter-current had an entry temperature (measured at the entry of the ring channel) of 218° C., and an exit temperature of 89.5° C. The smoke meter in the exhaust air showed a deflection of between 0.02 and 0.07 scale units, and with respect to the powder concentration the same conditions existed as given in Example 1. The powder leaving the spray-drying tower was cooled in the conveyor shaft to 30° C. with air of 24° C.

The spray-dried product consisted of more than 60% by weight of rodlet-like particles having an average length of from 0.7 to 2.7 mm, and an average diameter of from 0.1 to 0.7 mm for a ratio of diameter to length of from 1:1.6 to 1:5. The dust content was below 1% by weight. The powder density was 645 g/l, and the fluidity was 83%.

In a continuously used mixer the spray-dried product was simultaneously mixed with 10% by weight of sodium perborate and with 1.4% by weight of dry zeolite NaA (particle size range 0.5 to 7 micron). After admixing of 1% by weight of enzyme granulate and 3% by weight of granulated bleach activator (tetraacetylethylenediamine), the powder density rose to 690 g/l and the fluidity to 88%. The solubility in water was good and not affected.

EXAMPLE 3

Example 1 was repeated by using a sodium tripolyphosphate having 40% of the I-type. Before the addition of the phosphate the slurry was heated to 90° C. and subsequently pumped in closed circuit through a homogenization device. The viscosity was 11,000 mPa.s, and the water content was 43% by weight. The spraying was done at a pressure of 22 bars and through a spin nozzle orifice of 4.0 mm. The temperature of the drying air applied in counter-current was 215° C. at the tower entrance, and 89° C. at the tower exit. The other process parameters were the same as used in Example 1.

With respect to grain particle size the powder density the powder corresponded to that of Example 1. The fluidity was 86% of that of dry sand. An after treatment with 0.06% by weight of silicic acid aerogel (Aerosil®) improved the fluidity to 89% and resulted in an increase in powder density from 640 g/l to 660 g/l.

Example 4

Example 2 was repeated, however, with using a cooling air of 37° C. Because of the delayed cooling of the warm spray-dried powder, a slight sweating out of the nonionic surfactants at the surface of the grains was observed. Therefore, the fluidity of the powder decreased to 81% and the powder density to 620 g/l. By after-treatment with 1% by weight of zeolite NaA in a continuously working mixer the fluidity was improved to 86%, and the powder density was raised to 640 g/l.

In the foregoing examples the viscosity was determined by a rotation viscosimeter of Messrs. Brabender, Duisburg, Federal Republic of Germany.

Example 5

In a continuously working mixer 89 parts by weight of the spray-dried product of Example 1 were mixed with 1 part by weight of an enzyme granulate and 10 parts by weight of a surfactant compound. The surfactant compound was produced by spray mixing the following composition:

| Component | % by Weight |
|---|---|
| Na—dodecylbenzolsulfonate | 24.0 |
| Na—cocofattyalcoholsulfate | 24.0 |
| Zeolite NaA | 15.0 |
| Sodium tripolyphosphate | 15.0 |
| Water glass | 10.0 |
| Sodium sulfate | 2.0 |
| Water | 10.0 |
| Total | 100.0 |

The powder density measured 350 g/l, the grain size distribution was in the range of from 0.1 to 1.6 mm.

Thus a strongly foaming detergent composition was obtained with a powder density of 620 g/l.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A method for preparing a granular, freeflowing detergent component which dissolves rapidly in water, which has a powder density of from about 550 to 800 gm/l, more than 50% by weight of which comprises droplet-like to rodlet-like particles having an average diameter of from about 0.02 to 1.5 mm, an average length of from about 0.1 to 5 mm, and a ratio of average diameter to average length of from about 1:1.2 to 1:10, which method comprises spraying an aqueous suspension of synthetic, essentially nonionic surfactants, inorganic supports, additional organic washing aids, and water bound by adsorption and in hydrate form, the suspension containing from about 35 to 55% by weight of water, through nozzles having an orifice diameter of from about 3 to 5.5 m into a spray-drying tower under a pressure of from 16 to 30 bars and at a temperature equal to or less than about 250° C., the ratio of the pressure at the nozzle entrance to the nozzle orifice diameter being from about 3 to 9 bars/mm, wherein the product, as recovered from the spray-drying step, contains about 15 to 28% by weight of alkoxylated surfactant(s).

2. The method of claim 1, wherein the aqueous suspension contains from about 38 to 50% by weight of water.

3. The method of claim 1, wherein nozzles which apply spin to the material to be sprayed are used, the pressure at the nozzle entrance is from about 18 to 28 bars, the nozzle orifice diameter is from about 3.5 to 5 mm, and the ratio of the pressure to the diameter is from about 4 to 6 bars/mm.

4. The method of claim 3, wherein the pressure is from about 19 to 25 bars.

5. The method of claim 3, wherein the diameter is from about 3.5 to 4.5 mm.

6. The method of claim 3, wherein the ratio of the pressure to the diameter is from about 4.5 to 5.5 bars/mm.

7. The method of claim 1, wherein drying gases moving in counter-current direction to the material to be spray-dried have an entry temperature of from about 180° to 240° C. and an exit temperature of about 90° C.±15° C.

8. The method of claim 7, wherein the entry temperature is from about 190° to 220° C.

9. The method of claim 1, wherein the aqueous suspension comprises from about 42 to 55% by weight of water, inclusive of adsorptively bound water and water of hydration.

10. The method of claim 9, wherein the aqueous suspension comprises from about 44 to 52% by weight of water.

11. The method of claim 1, wherein said inorganic supports include an anhydrous sodium tripolyphosphate having a content of from 30 to 50% of the I-type modification.

12. The method of claim 11, wherein the content of the I-type modification in said anhydrous sodium tripolyphosphate is from 35 to 45%.

13. The method of claim 1, wherein the viscosity of said aqueous suspension is adjusted to values in the range of from 2000 to 15,000 mPa.s.

14. The method of claim 1, wherein the viscosity of said aqueous suspension is adjusted to values in the range of from 5000 to 12,000 mPa.s.

15. The method of claim 1, wherein the viscosity of said aqueous suspension is adjusted to values in the range of from 6000 to 10,000 mPa.s.

16. The method of claim 1, wherein said inorganic supports include an anhydrous sodium tripolyphosphate and said aqueous suspension is heated to a temperature above 85° C. prior to the addition of said tripolyphosphate.

17. The method of claim 1, wherein said inorganic supports include an anhydrous sodium tripolyphosphate and said aqueous suspension is heated to a temperature of 86° to 102° C. prior to the addition of said tripolyphosphate.

18. The method of claim 1, wherein said spray-dried product is cooled within 5 minutes to a temperature below 35° C.

19. The method of claim 1, wherein said spray-dried product is cooled within 2 minutes to a temperature of from 20° to 30° C.

20. The method of claim 1 or 19, wherein said sparydried product is treated in a mixing device with 0.01 to 3% by weight of a water-soluble or water-dispersable finely divided solid material as fluidity improving agent.

21. The method of claim 1 or 19, wherein said spray-dried product is treated with 0.1 to 2% by weight of zeolite of the NaA type, or with 0.05 to 0.5% by weight of microfine silica, respectively.

22. A detergent component prepared according to the method of claim 1.

23. The detergent component of claim 22 which comprises less than about 1% by weight of anionic surfactants, and less than 0.2% by weight of soap.

24. The detergent component of claim 23 which comprises from about 17 to 25% by weight of alkoxylated nonionic surfactants.

25. The detergent component of claim 24 which comprises from about 18 to 23% by weight of alkoxylated nonionic surfactants.

26. The detergent component of claim 23 which comprises less than about 0.5% by weight of anionic surfactants.

27. The detergent component of claim 23 which comprises about 0% by weight of soap.

28. The detergent component of claim 22 which contains, for a content of from about 40 to 80% by weight of inorganic support, including from about 10 to 60% by weight of sodium tripolyphosphate, including its hydrolysis products, from about 5 to 20% by weight of alkali metal silicate, and from about 0 to 40% by weight of finely crystalline sodium aluminosilicate of the zeolite A-type containing bound water, based upon the weight of the spray-dried product.

29. The detergent component of claim 28 which contains from about 45 to 70% by weight of inorganic support.

30. The detergent component of claim 28, wherein the alkali metal silicate has a ratio of $Na_2O$ to $SiO_2$ of from about 1:1.5 to 1:3.5.

31. The detergent component of claim 28 which contains as inorganic support from about 15 to 50% by weight of sodium tripolyphosphate, including its hydrolysis products, from about 6 to 15% by weight of sodium silicate, the ratio of $Na_{20}$ to $SiO_2$ being from about 1:2 to 1:2.5, and from about 3 to 30% by weight of zeolite NaA, based upon the weight of the spray-dried product.

32. The detergent component of claim 22 which comprises from about 0.5 to 10% by weight of additional organic washing aids and from about 8 to 20% by weight of water bound by adsorption and in hydrate form, based upon the total weight of the spray-dried product.

33. The detergent component of claim 22 which consists of compact, non-porous particles having an uninterrupted surface, more than about 60% by weight of the particles having an average diameter of from about 0.05 to 1 mm, an average length of from about 0.3 to 3 mm, and a ratio of average diameter to average length of from about 1:1.4 to 1:8.

34. The detergent component of claim 22, wherein the surface of the particles has a grained to striated texture.

35. The detergent component of claim 22, wherein the powder density is from about 600 to 750 gm/l.

36. The detergent component of claim 22, wherein the grains have a coating of a finely divided water-soluble or water-dispersable solid material as fluidity improving agent, in an amount of from 0.01 to 3% by weight of the granular spray-dried product.

37. The detergent component of claim 36, wherein said coating consists of from 0.1 to 2% by weight of zeolite of the NaA type.

38. The detergent component of claim 36, wherein said coating consists of from 0.05 to 0.5% by weight of microfine silica.

* * * * *